US005896157A

United States Patent [19]

Fisher, Sr.

[11] Patent Number: 5,896,157

[45] Date of Patent: Apr. 20, 1999

[54] CLEANING DISC AND METHOD FOR CLEANING A FEED ROLLER BELONGING TO AN IMAGING DEVICE

[75] Inventor: Terrence L. Fisher, Sr., Rochester, N.Y.

[73] Assignee: Eastman Kodak Company, Rochester, N.Y.

[21] Appl. No.: 09/014,309

[22] Filed: Jan. 27, 1998

[51] Int. Cl.[6] ..... B41J 29/17

[52] U.S. Cl. ..... 347/171; 15/256.5; 15/118

[58] Field of Search ..... 347/171; 400/701, 400/702; 15/118, 104.93, 256.5, 256.51, 256.52, 256.53

[56] References Cited

U.S. PATENT DOCUMENTS

| | | | |
|---|---|---|---|
| 3,983,813 | 10/1976 | Tani | 15/57 |
| 4,868,699 | 9/1989 | Kingsbury et al. | 360/128 |
| 5,138,390 | 8/1992 | Miyabayashi et al. | 15/256.51 |
| 5,227,844 | 7/1993 | Bhattacharjee et al. | 15/104.93 |

FOREIGN PATENT DOCUMENTS

| | | |
|---|---|---|
| 3-005782 | 1/1991 | Japan . |
| 3-010875 | 1/1991 | Japan . |

*Primary Examiner*—Huan Tran
*Attorney, Agent, or Firm*—Walter S. Stevens

[57] ABSTRACT

A cleaning disc for removing contaminant matter from a rotatable feed roller belonging to an imaging device. The disc comprises a cleaning layer, which may be a tack layer or an abrasion layer, engageable with the roller and rotatable therewith. The cleaning layer removes the contaminant matter as the cleaning layer engages and rotates with the roller. The cleaning layer is attached to a substrate for supporting the cleaning layer, the substrate having a protruding portion thereof sized to be slidably received in the recess to fix position of the disc to act as a pivot with respect to the feed roller. In addition, a protective layer is removably attached to the cleaning layer for protecting the cleaning layer prior to use.

12 Claims, 9 Drawing Sheets

CLEANING DISC AND METHOD FOR CLEANING A FEED ROLLER BELONGING TO AN IMAGING DEVICE

BACKGROUND OF THE INVENTION

This invention generally relates to apparatus and methods for cleaning feed rollers and more particularly relates to a cleaning disc and method for cleaning a feed roller belonging to an imaging device.

Cleaning devices for cleaning feed rollers of imaging apparatus are known. One such device is disclosed in U.S. Pat. No. 5,227,844 titled "Cleaning Sheet And Method For Cleaning Paper Path Feed Roller Surfaces" issued Jul. 13, 1993, in the name of Himangshy R. Bhattacharjee, et al. This patent discloses passing a cleaning sheet along a paper path of an imaging machine to clean feed roller surfaces in the paper path. The cleaning sheet includes a substrate carrying a coating of synthetic polymeric material in a pattern which assures contact between the coating and the feed surfaces to be cleaned. The coating material has a tack which enables the coating to pick-off particles of unwanted material from the feed roller surfaces and capture the picked-off particles for movement with the cleaning sheet along the paper path and out of the machine. Thus, the cleaning sheet disclosed in this patent moves through the machine along the same path as a sheet of receiver medium would move through the machine. It would appear, however, that use of this device gives rise to at least the risk that the particles picked-up from the feed rollers may be inadvertently redeposited on other printer components (e.g., printhead) laying along the paper path. Moreover, it appears no means is provided to control the amount of time the cleaning sheet remains in contact with the feed rollers because the sheet is apparently automatically fed through the machine at the normal operating feeding rate of the machine. Thus, heavily contaminated feed rollers may require multiple pass-throughs of the cleaning sheet before the feed rollers are adequately cleaned.

Therefore, there has been a long-felt need to provide a suitable cleaning apparatus and method for cleaning a feed roller belonging to an imaging device, so that the problems stated hereinabove are overcome.

SUMMARY OF THE INVENTION

The present invention resides in a cleaning disc for removing contaminant matter from a rotatable feed roller belonging to an imaging device. The disc comprises a cleaning layer, which may be a tack layer or an abrasion layer, engageable with the roller and rotatable therewith. The cleaning layer removes the contaminant matter as the cleaning layer engages and rotates with the roller. In addition, a protective layer is removably attached to the cleaning layer for protecting the cleaning layer prior to use.

An object of the present invention is to provide a cleaning disc and method for cleaning a feed roller belonging to an imaging device without disassembly of the device.

Another object of the present invention is to provide a cleaning disc and method which reduces risk of inadvertently contaminating internal components of the device.

A feature of the present invention is the provision of a cleaning layer, which may be a tack layer or an abrasion layer, engageable with the roller for removing the contaminant matter as the cleaning layer engages the roller.

An advantage of the present invention is that the roller can be cleaned without disassembly of the imaging device.

Another advantage of the present invention is that heavily contaminated feed rollers can be cleaned without multiple pass-throughs of a cleaning sheet.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunctions with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
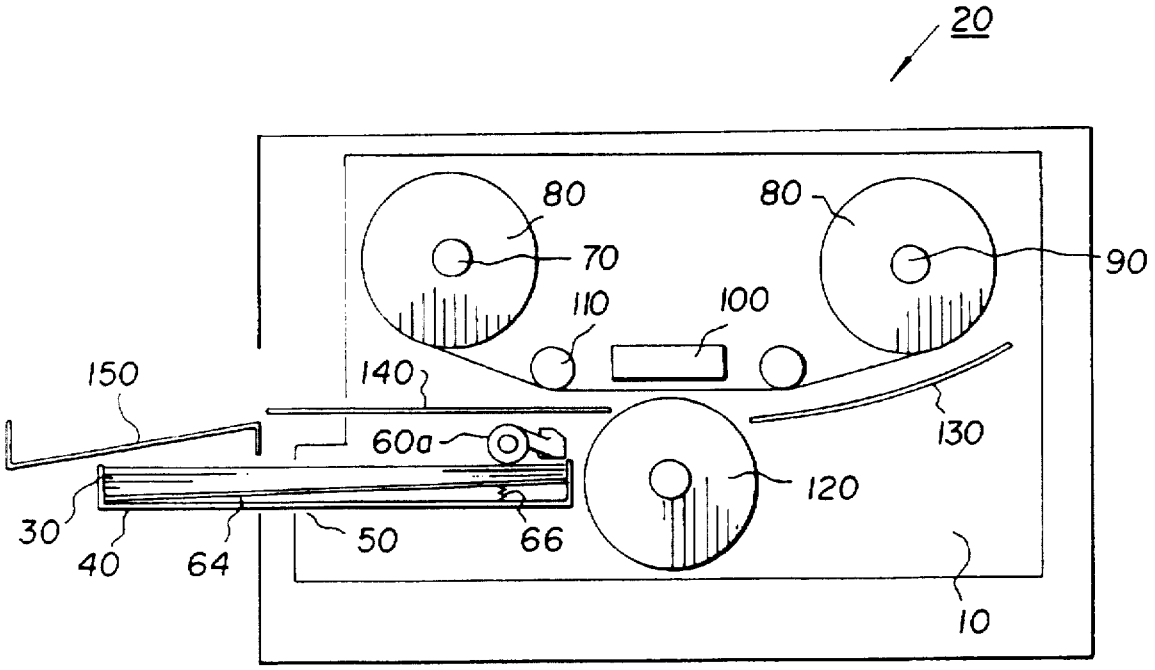
FIG. 1 is a view in elevation of an imaging device, with parts removed for clarity.
Figure 4A:
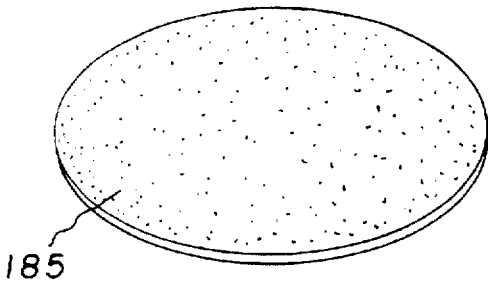
FIG. 4A is a perspective view the cleaning disc having a roughened surface thereon.
Figure 2:
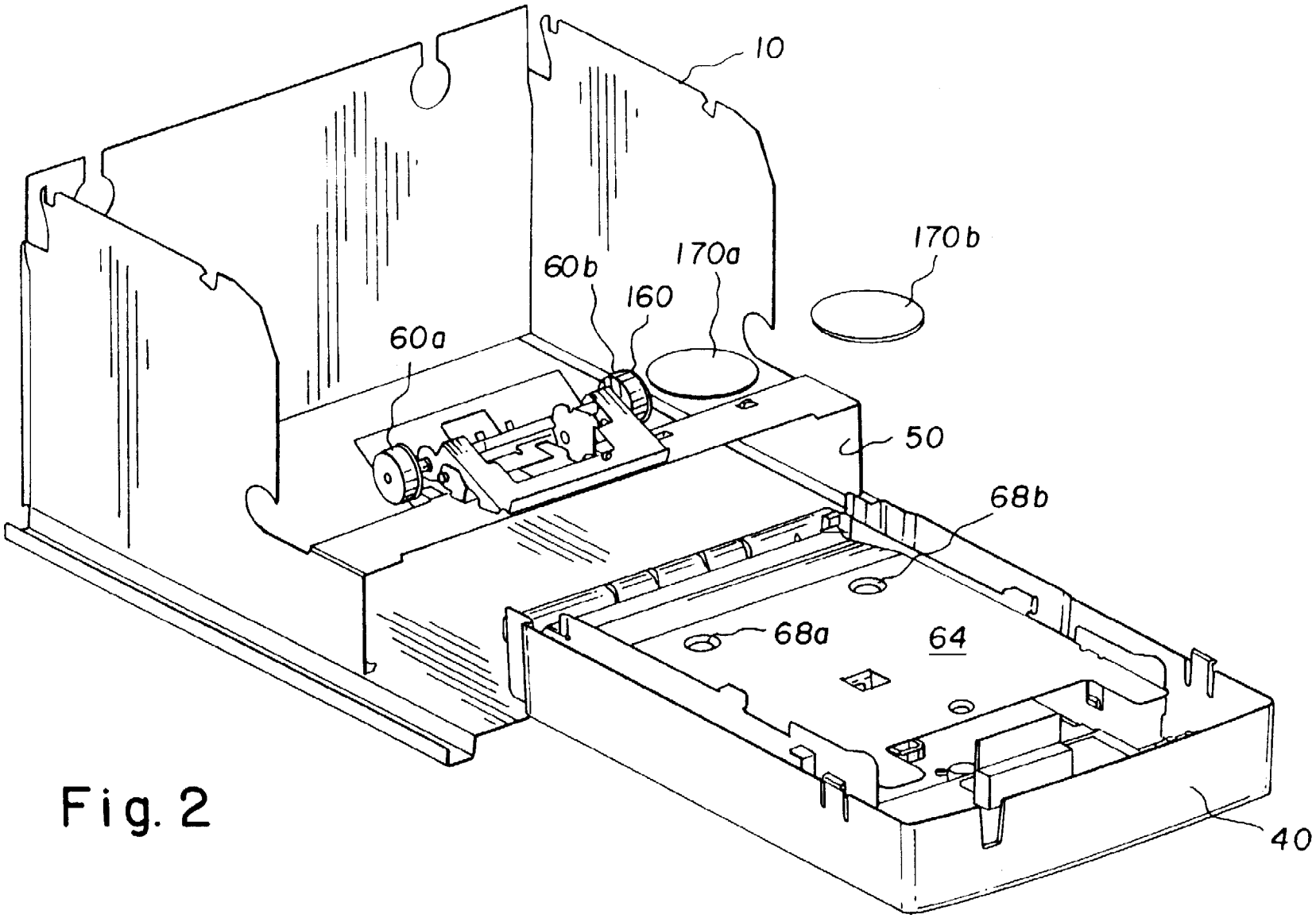
FIG. 2 is a view in perspective of a frame member belonging to the imaging device, the frame member having a pair of contaminated picker rollers connected thereto.
Figure 3:
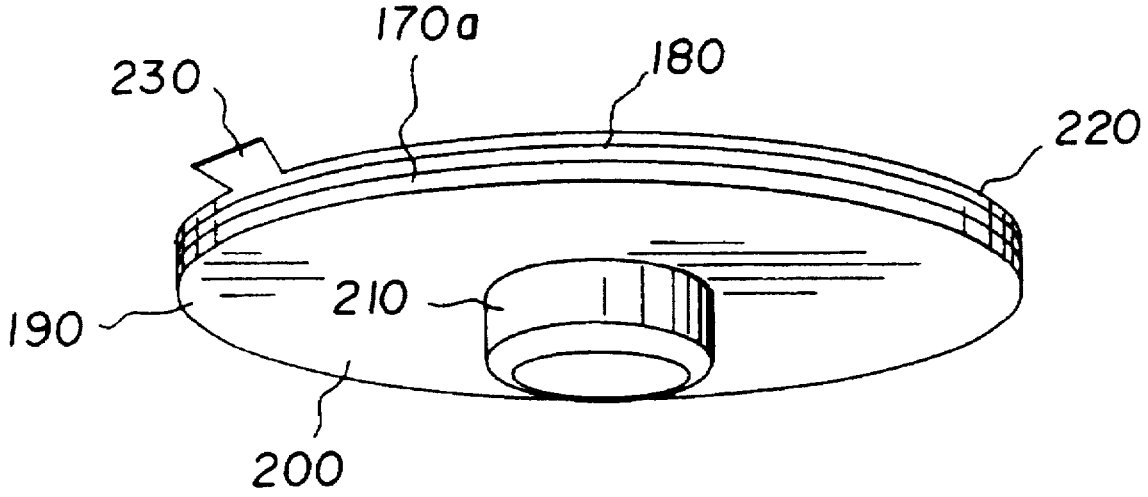
FIG. 3 is a view in perspective of a first embodiment cleaning disc belonging to the present invention.
Figure 4:
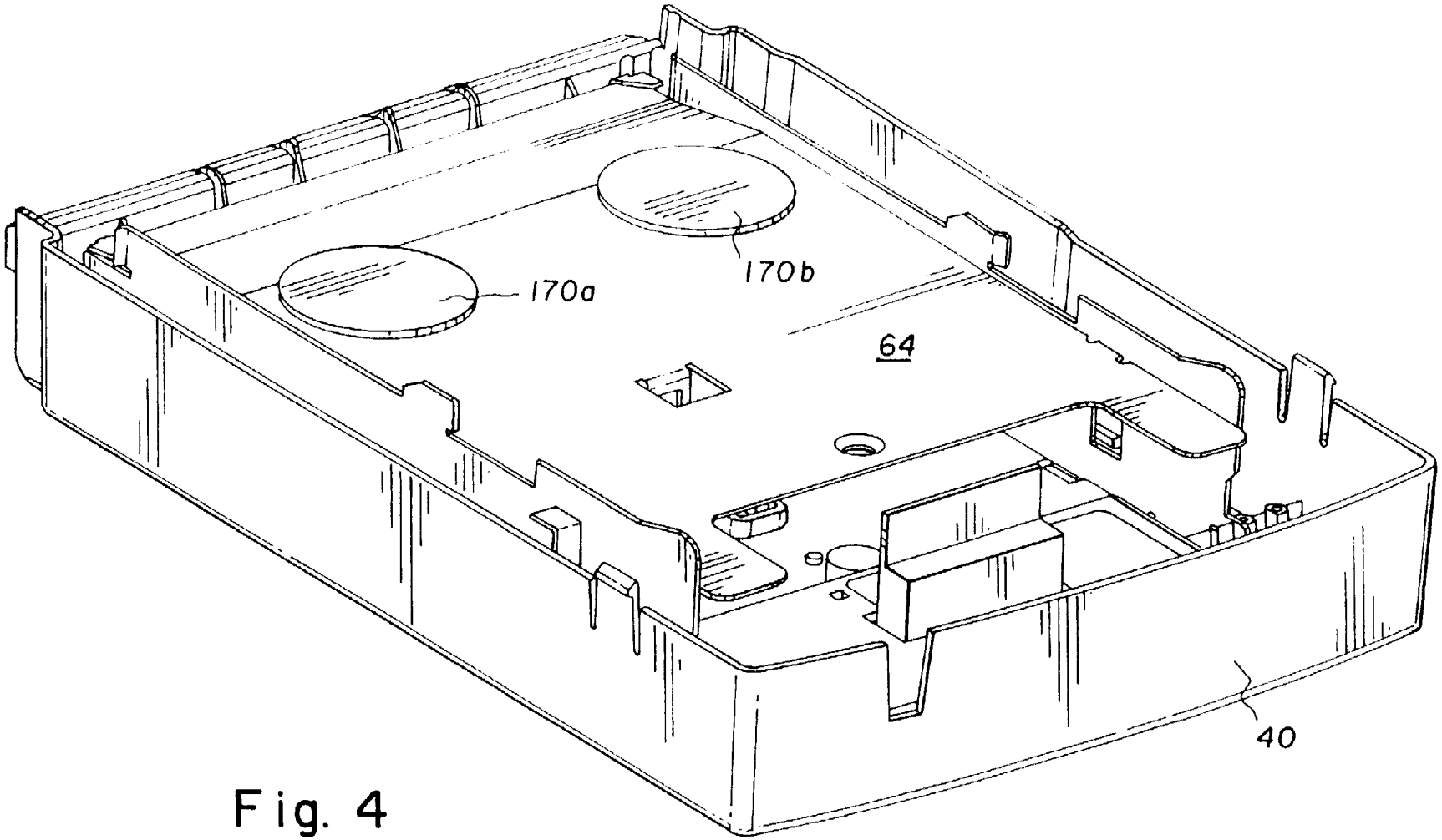
FIG. 4 is a view of a pair of the first embodiment cleaning discs connected to a receiver supply tray which is insertable into the frame member.

Referring to FIGS. 1 and 2, there is shown a frame member 10, belonging to an imaging device, generally referred to as 20, capable of forming an image on a receiver medium 30, which may be cut sheets of paper or transparency. A receiver medium supply tray 40 is received into an opening 50 defined by frame member 10, such that individual sheets of receiver medium 30 can be engaged by a pair of motorized rotatable picker rollers 60 *a/b* and "picked" from receiver supply tray 40, the picker rollers 60 being connected to frame member 10. Picker rollers 60 are motorized not only to rotate picker rollers 60, but also to lower picker rollers 60 from a first position thereof spaced-apart from supply tray 40 to a second position adjacent to supply tray 40. Supply tray 40 includes a spring-loaded platen 64 for supporting receiver medium 30 thereon. Platen 64 is capable of being biased by means of a spring member 66 in order to bias each sheet of receiver medium 30 into intimate engagement with picker rollers 60 when picker rollers 60 are lowered into contact with receiver medium 30. Moreover, for reasons disclosed hereinbelow, platen 64 advantageously has a pair of holes (i.e., recesses) 68*a* and 68*b* vertically alignable with picker rollers 60 when supply tray 40 is inserted through opening 50 which occurs during operation of imaging device 20.

Still referring to FIGS. 1 and 2, imaging device 20 also includes a dye donor supply reel 70 having a supply of dye donor ribbon 80 wound thereabout. Spaced-apart from donor supply reel 70 is a motorized and rotatable dye donor take-up reel 90 for taking-up donor ribbon 80. Thus, as donor take-up reel 90 is caused to rotate, donor ribbon 80 is fed from donor supply reel 70 to donor take-up reel 90. In addition, imaging device 20 includes a movable thermal resistive printhead 100 interposed between donor supply reel 70 and donor take-up reel 90 for thermally activating donor ribbon 80 in order to release dye therefrom. Moreover, a plurality of tensioning rollers 110 are disposed on either side of printhead 100 for tensioning donor ribbon 80 as donor ribbon 80 feeds from supply reel 70 to take-up reel 90. Imaging device 20 further includes a rotatable support roller 120 disposed opposite printhead 100 for supporting receiver 30. Printhead 100 and support roller 120 define a nip therebetween. As receiver medium 30 is picked from receiver supply tray 40 by picker roller 60, receiver medium 30 is guided by a guide (not shown) into the nip and into engagement with support roller 120, whereupon printhead 100 is lowered from a first position thereof spaced-apart from support roller 120 to a second position thereof adjacent to support roller. Rotation of support roller 120 and take-up reel 90 are synchronized as printhead 100 is activated in order to transfer dye from donor ribbon 80 to receiver medium 30. As dye transfers form donor ribbon 80, the image forms on receiver medium 30. A holding trough 130 aligned with the nip may also be provided to temporarily hold the sheet of receiver medium 30 being printed as it passes through the nip. When the image to be formed on the individual sheet of receiver medium 30 is finally printed, the sheet of receiver medium 30 is guided along a guide path 140 and from there into a receiver medium output tray 150 for retrieval by an operator of imaging device 20.

However, it has been observed that picker rollers 60 may become contaminated by dirt, dust, oil or other contaminant matter 160. Such contamination or fouling of picker rollers 60 is undesirable because such contamination may cause picker rollers 60 to slip. Slippage of picker rollers 60 may prevent picker rollers 60 from suitably "picking" sheets of receiver medium 30 from supply tray 40. This, in turn, can lead to misfeeding of receiver sheets 30 into the previously mentioned nip thereby causing receiver sheet "jamming", a highly undesirable result. Not only mist the jammed receiver sheet be removed; but, imaging device 20 may have to be at least partially disassembled in order to clean picker roller 60*a/b*. In any event, substantial down-time may occur as a result of the contaminated picker rollers, thereby leading to increased costs for a production run. Hence, it is desirable to periodically clean contaminant matter 160 from picker rollers 60 in a time-efficient and cost-effective manner.

Therefore, referring to FIGS. 2, 3, 4, and 4A, a pair of generally circular cleaning discs 170*a/b* are provided for removing (i.e., cleaning) contaminant matter 160 from picker rollers 60*a/b*, respectively. Cleaning discs 170*a/b* are preferably formed of an inexpensive and easily disposable material, such as cardboard. In addition, cleaning discs 170*a*/170*b* may have a transverse thickness of approximately 0.025 to 0.030 inches. Each cleaning disc 170*a/b* comprises a cleaning layer 180 (thickness shown in the Figures exaggerated for clarity) that engages picker rollers 60 when supply tray 40 is inserted through opening 50, as described in detail hereinbelow. In one embodiment of the present invention, cleaning layer 180 may be a tack layer for removing contaminant matter 160 by adhesion to cleaning layer 180. In this regard, cleaning layer (i.e., tack layer) 180 may be formed of a suitable adhesive, such as found on the "POST-it"™ brand labels available from Minnesota Mining and Manufacturing Company, located in Saint Paul, Minn. Alternatively, cleaning layer 180 merely may have a roughened surface 185, rather than a tack layer thereon. In this case, surface 185 may have a roughness equivalent to what is known in the art as a "709 microinch finish", or other suitable finish. Cleaning layer 180 is supported by a generally circular substrate 190 of diameter corresponding to generally circular cleaning layer 180. Substrate 190 is attached to cleaning layer 180, such as by a suitable adhesive. In one embodiment of the invention, each substrate 190 defines an underside or bottom surface 200 having a protruding portion, such as a nipple 210, protruding perpendicularly therefrom. Nipple 210 is sized to be slidably received into the recess 68*a/b* associated therewith. Clearance between each nipple 210 and its respective recess 68*a/b* is such that each nipple 210, and thus each disc 170*a/b*, is freely rotatable in recess 68*a/b*, for reasons disclosed hereinbelow. If desired, a generally circular protective layer 220 having a diameter corresponding to diameter of cleaning layer 180 may be removably attached to cleaning layer 180 for protecting cleaning layer 180 prior to use thereof. Protective layer 220 can be removably attached to cleaning layer 180, such as by means of a suitable gummed adhesive. Such a gummed adhesive preferably does not leave a residue on cleaning layer 180 once protective layer 220 is removed. Protective layer 220 may be formed of any suitable gummed paper, such as the previously mentioned "POST-it"™ brand label. Protective layer 220 preferably includes an outwardly extending tab portion 230 that can be grasped and pulled to remove protective layer 220 so that discs 170*a/b* may be used to clean picker rollers 60*a*/60*b*.

Figure 5:
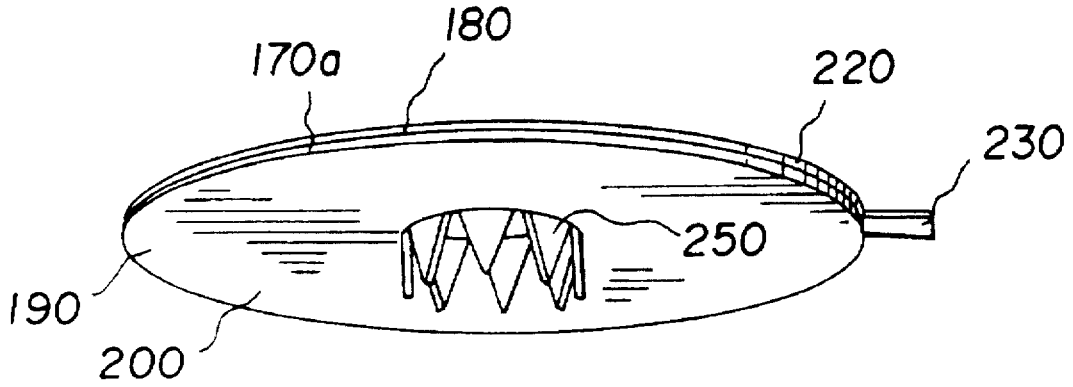
FIG. 5 is a view in perspective of a second embodiment cleaning disc belonging to the present invention.
Figure 6:
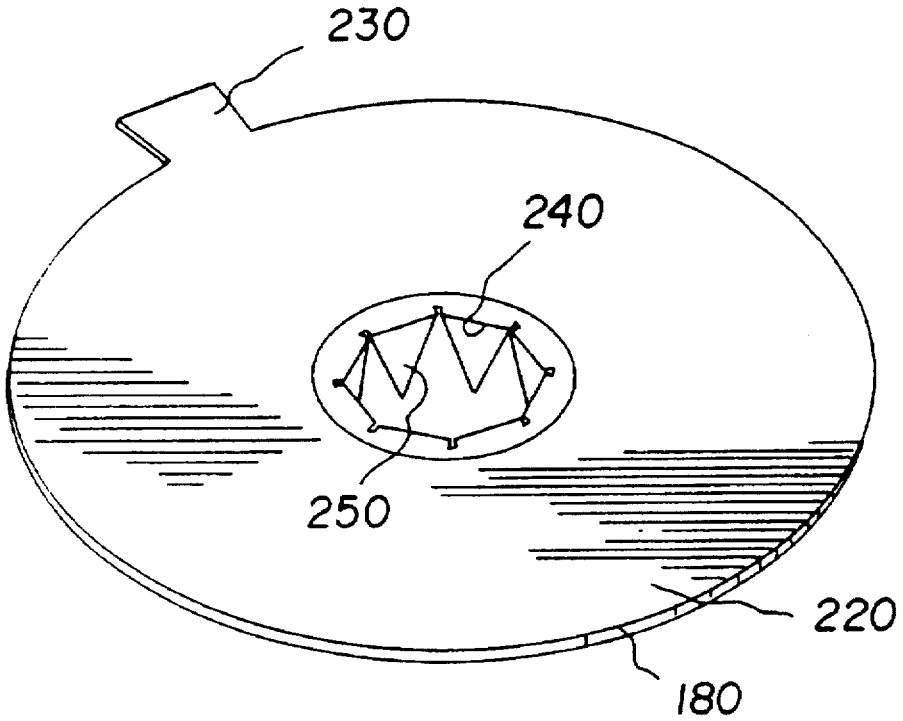
FIG. 6 is an enlarged view of the second embodiment cleaning disc.
Figure 7:
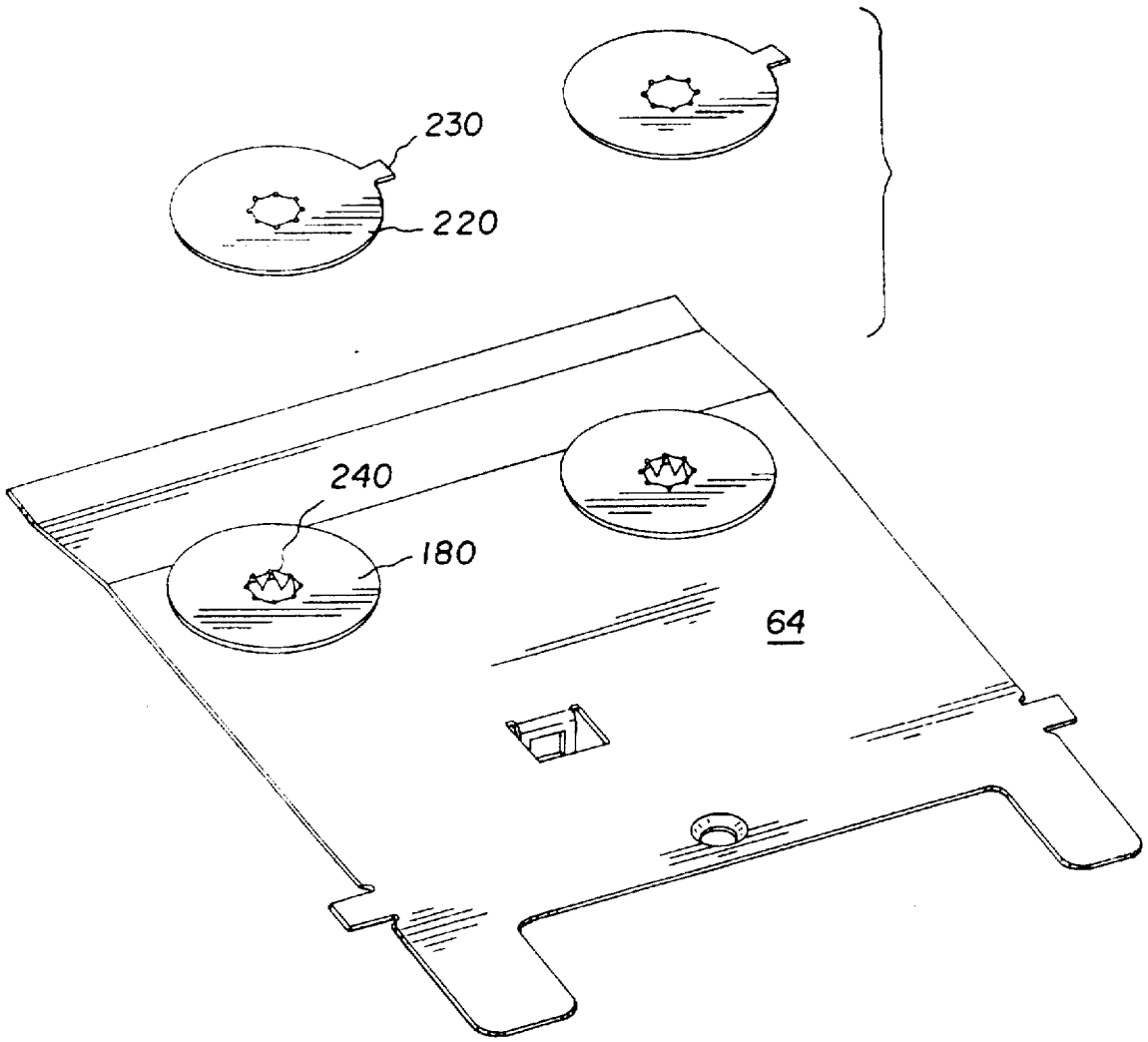
FIG. 7 is a view of a pair of the second embodiment cleaning discs connected to a platen belonging to the receiver supply tray which is insertable into the frame member.
Figure 8:
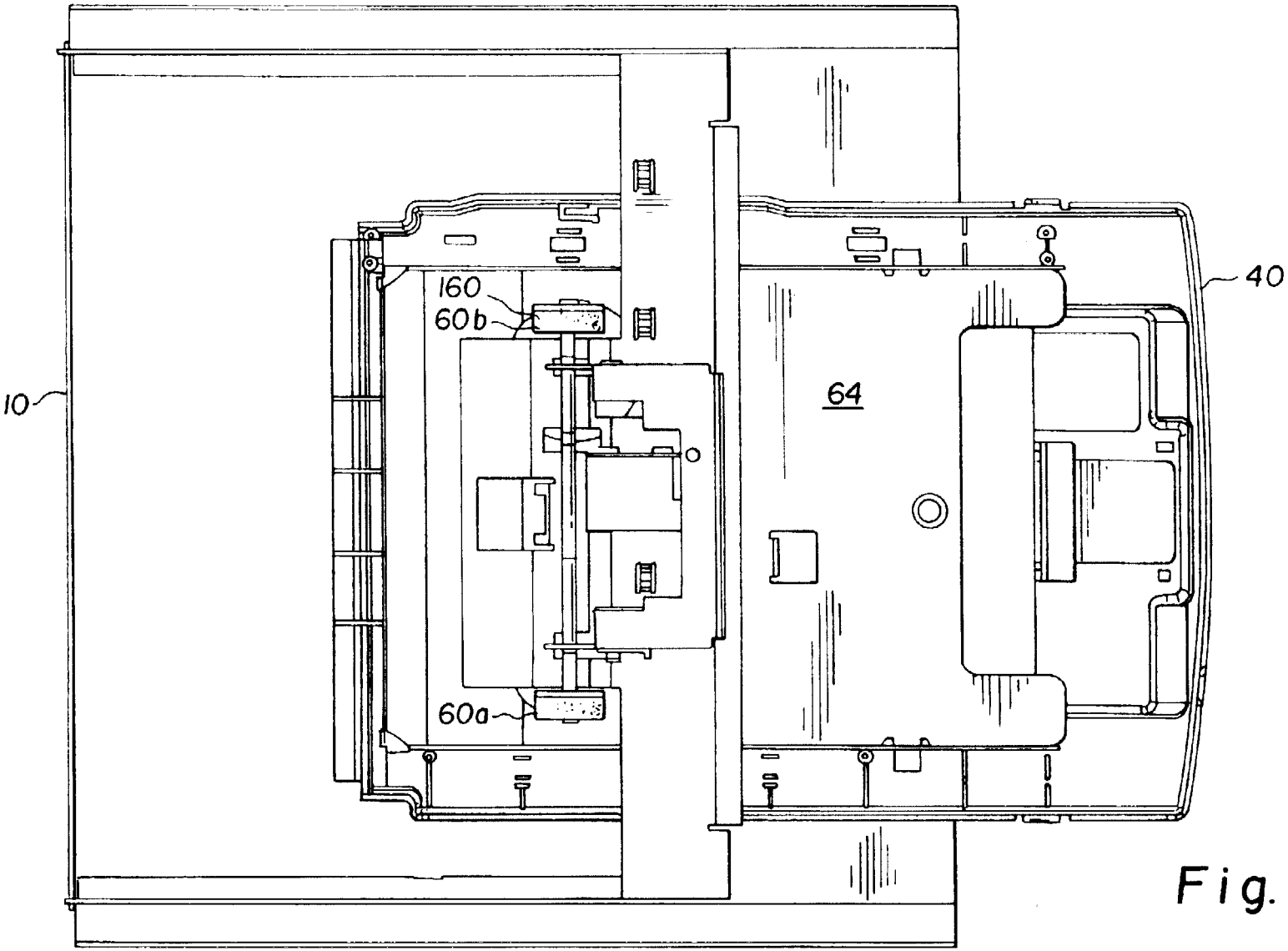
FIG. 8 is a view a plan view of the supply tray and connected cleaning discs disposed in the frame member such that the cleaning discs vertically align with the picker rollers.
Figure 9:
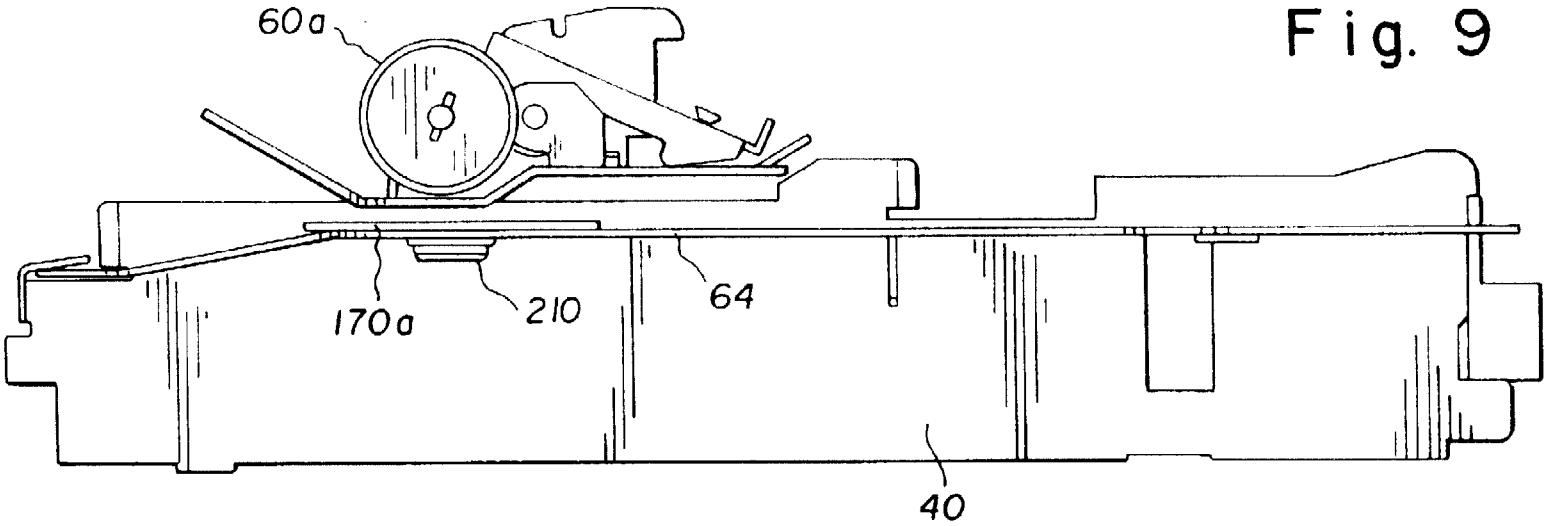
FIG. 9 is a view in elevation of the supply tray and connected cleaning disc disposed such that the cleaning discs vertically aligns with raised picker rollers.
Figure 10:
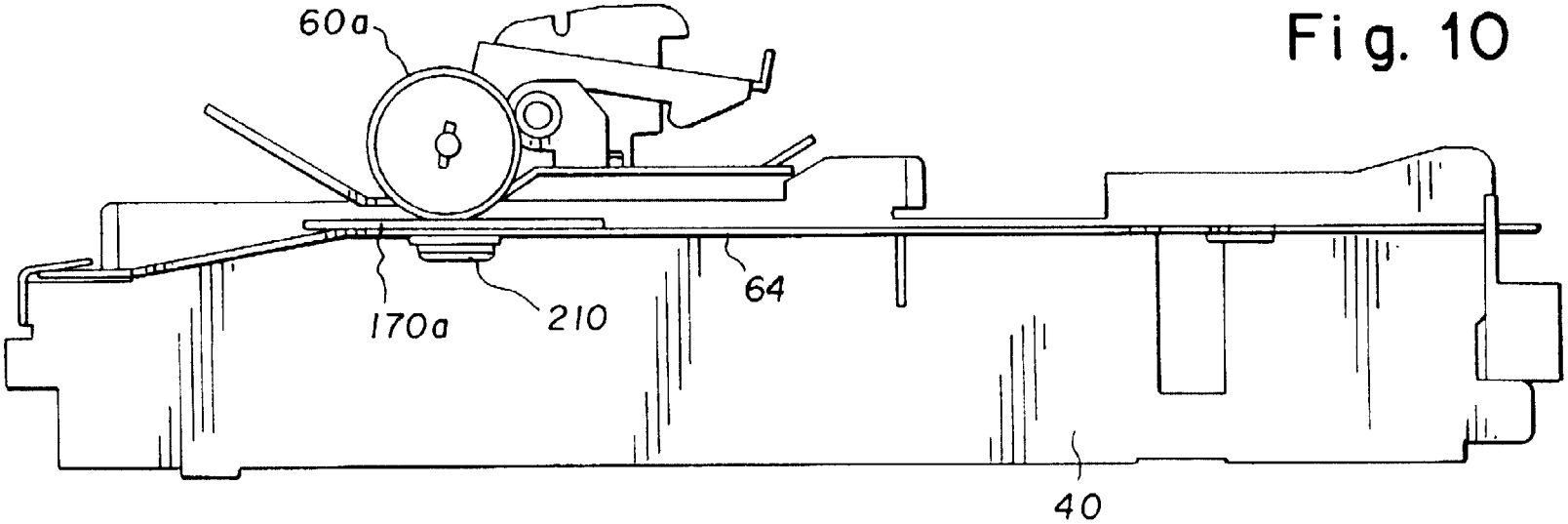
FIG. 10 is a view in elevation of the supply tray and connected cleaning disc disposed such that the cleaning disc vertically aligns with and is engaged by lowered picker rollers.
Figure 11:
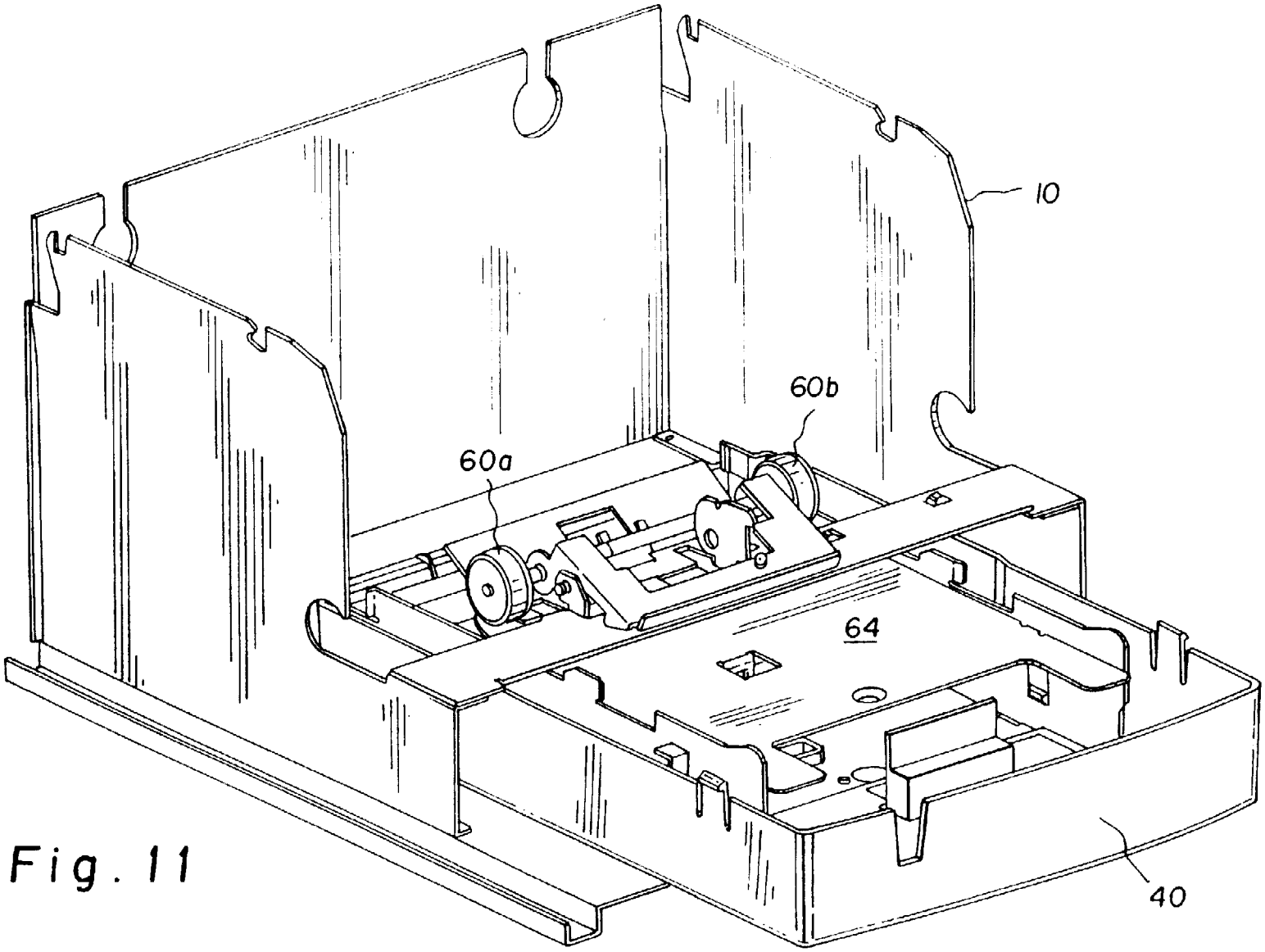
FIG. 11 is a view in perspective of the pickers rollers in a raised position after having been cleaned by the cleaning discs.

Referring to FIGS. 5, 6, and 7, there is shown a second embodiment of the present invention. In this second embodiment of the invention, nipple 210 is absent. Rather, an aperture 240 is cut through the center of each disc 170*a*/170*b* in such a manner that a plurality of spike-shaped members 250 are formed projecting perpendicularly outwardly from bottom surface 200. An advantage of using such spike-shaped members 250 is that members 250 retain discs 170*a*/170*b* in their respective recesses 68*a*/68*b*. That is, discs 170*a*/170*b* are retained in their respective recesses 68*a*/68*b* because when members 250 are placed in the appropriate recess or opening in the platen, discs 170*a*/170*b* are allowed to rotate when contacted by picking rollers 60*a*/60*b*. Spike-shaped members 250 are configured to be received into respective recesses 68*a*/68*b* defined by platen 64.

Turning now to FIGS. 8, 9, 10, and 11, cleaning discs 170*a/b* are removably connected to platen 64 by sliding the protruding portion (either nipple 210 or spike-shaped members 250, as the case may be) into its respective recess 68*a*/68*b*. Tab portion 230 is grasped and pulled, so that protective layer 220 peels from cleaning layer 180. Supply tray 40 is then inserted into opening 50 until each cleaning disc 170*a/b* vertically aligns with a respective picker roller 60*a/b*. Imaging device 10 is then operated so that picker rollers 60*a/b* lower from the first position thereof to the second position thereof and then rotate. As picker rollers 60*a/b* are lowered and rotated, they will engage cleaning layer 180 of each disc 170*a*/170*b*. As previously mentioned, each disc 170*a/b* is freely rotatable in its associated recess 68*a/b*. Thus, as picker rollers 60*a/b* rotate, discs 170*a/b* will also rotate to a like extent, but in an opposite direction to rotation of picker rollers 60*a*/60*b*. If cleaning layer 180 is a tack layer, contaminant matter 160 present on picker rollers 60*a*/60*b* will adhere to cleaning layer 180 to decontaminate picker rollers 60*a/b*. On the other hand, if cleaning layer 180 has a surface of predetermined roughness, cleaning layer 180 will remove contaminant matter 160 by abrasion. Contact of cleaning layer 180 with picker rollers 60*a/b* continues for a suitable time, depending on the amount of decontamination desired. In this manner, contaminant matter 160 is removed from picker rollers 60*a/b*.

It may be appreciated from the teachings herein that an advantage of the present invention is that picker rollers 60*a/b* are cleaned of contaminant matter 160 without disassembly of imaging device 20. This is so because cleaning discs 170*a/b* are usable with supply tray 40, which is merely inserted into and retrieved from frame member 10, which belongs to imaging device 20.

It may be appreciated from the teachings herein that another advantage of the present invention is that heavily contaminated picker rollers can be cleaned without multiple pass-throughs of a cleaning sheet, as disclosed in the prior art. This is so because cleaning discs, rather than sheets, are used.

While the invention has been described with particular reference to its preferred embodiments, it is understood by those skilled in the art that various changes may be made and equivalents may be substituted for elements of the preferred embodiments without departing from the invention. For example, although cleaning discs 170*a/b* are described herein in association with use in a thermal resistive printer, cleaning discs 170*a/b* are also suitable for use in similar imaging devices, such as inkjet printers, or whenever picker rollers are used to feed a medium along a feed path.

As is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a cleaning disc and method for cleaning a feed roller belonging to an imaging device.

Parts List

10 . . . frame member
20 . . . imaging device
30 . . . receiver medium
40 . . . receiver medium supply tray
50 . . . opening
60 . . . picker rollers
64 . . . platen
66 . . . spring member
68 . . . holes
70 . . . dye donor supply reel
80 . . . dye donor ribbon
90 . . . dye take-up reel
100 . . . printhead
110 . . . tensioning rollers
120 . . . support roller
130 . . . holding trough
140 . . . guide path
150 . . . output tray
160 . . . contaminant matter
170*a/b* . . . cleaning discs
180 . . . cleaning layer
185 . . . roughened surface
190 . . . substrate
200 . . . bottom surface
210 . . . nipple
220 . . . protective layer
230 . . . tab portion
240 . . . aperture
250 . . . spike-shaped members

What is claimed is:

1. A cleaning disc for removing contaminant matter from a rotatable feed roller belonging to an imaging device, the device adapted to receive a receiver supply tray having a platen defining a recess therein, comprising:

(a) a cleaning layer engageable with the roller and rotatable oppositely therewith, so that said cleaning layer removes the contaminant matter as said cleaning layer engages and rotates with the roller; and (b) a substrate attached to said cleaning layer for supporting said cleaning layer, said substrate having a protruding portion thereof sized to be slidably received in the recess.

2. The disc of claim 1, wherein said cleaning layer is substantially formed of a low adhesive surface for removing the contaminant matter by adhesion thereto.

3. The disc of claim 1, wherein said cleaning layer has a roughness equivalent to "709 microinch finish" for removing the contaminant matter by abrasion.

4. The disc of claim 1, further comprising a protective layer removably attached to said cleaning layer for protecting said cleaning layer prior to use thereof.

5. The disc of claim 1, wherein the protruding portion of said substrate is a nipple-shaped member.

6. The disc of claim 1, wherein the protruding portion of said substrate is a spike-shaped member.

7. A method of removing contaminant matter from a rotatable feed roller belonging to an imaging device, the device adapted to receive a receiver supply tray having a platen defining a recess therein, comprising the steps of:

(a) engaging a cleaning layer with the roller, the cleaning layer being rotatable oppositely with respect to the roller, so that the cleaning layer removes the contaminant matter as the cleaning layer engages and rotates with the roller; and (b) attaching a substrate to the cleaning layer for supporting the cleaning layer, the substrate having a protruding portion thereof sized to be slidably received in the recess.

8. The method of claim 7, wherein the step of engaging the cleaning layer with the roller comprises the step of engaging a cleaning layer substantially formed of a low adhesive surface for removing the contaminant matter by adhesion thereto.

9. The method of claim 7, wherein the step of engaging the cleaning layer with the roller comprises the step of engaging a cleaning layer having a roughness equivalent to "709 microinch finish" for removing the contaminant matter by abrasion.

10. The method of claim 7, further comprising the step of removably attaching a protective layer to the cleaning layer for protecting the cleaning layer prior to use thereof.

11. The method of claim 7, wherein the step of attaching a substrate to the cleaning layer comprises the step of attaching a substrate having a nipple-shaped member sized to be slidably received in the recess.

12. The method of claim 7, wherein the step of attaching a substrate to the cleaning layer comprises the step of attaching a substrate having at least one spike-shaped member sized to be slidably received in the recess.

* * * * *